US007651295B2

(12) United States Patent
Eppes et al.

(10) Patent No.: US 7,651,295 B2
(45) Date of Patent: Jan. 26, 2010

(54) EXTENSION SCREED FOR A PAVING VEHICLE

(75) Inventors: Michael S. Eppes, Carlisle, PA (US); Eric Potter, Charleston, IL (US); Christopher W. Rahn, Neoga, IL (US)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 10/548,349

(22) PCT Filed: Mar. 5, 2004

(86) PCT No.: PCT/US2004/007196

§ 371 (c)(1),
(2), (4) Date: Apr. 13, 2007

(87) PCT Pub. No.: WO2004/081287

PCT Pub. Date: Sep. 23, 2004

(65) Prior Publication Data

US 2007/0258769 A1 Nov. 8, 2007

Related U.S. Application Data

(60) Provisional application No. 60/452,883, filed on Mar. 7, 2003.

(51) Int. Cl.
*E01D 15/10* (2006.01)

(52) U.S. Cl. ..... 404/84.05; 404/84.1; 404/86; 404/89; 404/93; 404/101; 404/104; 404/118

(58) Field of Classification Search ..... 404/104, 404/118, 84.05–890, 93, 98, 102, 105, 110, 404/114

See application file for complete search history.

(56) References Cited

U.S. PATENT DOCUMENTS

| | | | | |
|---|---|---|---|---|
| 3,557,672 | A * | 1/1971 | Shurtz et al. | 404/95 |
| 3,572,227 | A * | 3/1971 | Poulsen | 404/104 |
| 3,907,451 | A * | 9/1975 | Fisher et al. | 404/101 |
| 3,957,384 | A * | 5/1976 | Lamb et al. | 404/118 |
| 4,379,653 | A * | 4/1983 | Brown | 404/118 |

(Continued)

FOREIGN PATENT DOCUMENTS

| | | |
|---|---|---|
| DE | 10028819 | 1/2001 |

(Continued)

*Primary Examiner*—Raymond W Addie
(74) *Attorney, Agent, or Firm*—Michael Best & Friedrich LLP

(57) ABSTRACT

An extension screed is for a paving vehicle screed assembly that includes a main screed. The extension screed includes two base members movably connectable with the main screed and two vertical actuators each extending between the main screed and a separate base member. Each vertical actuator linearly displaces the connected base member with respect to the main screed in opposing vertical directions. A carriage preferably includes an inner frame movably connected with the base members and an outer frame slidably disposed about the inner frame and configured to support a screed plate. The vertical actuators vertically displace the carriage and alternatively pivot the carriage within a vertical plane. Further, a first horizontal actuator displaces the inner frame with respect to the two base members in opposing horizontal directions and a second horizontal actuator displaces the outer fame with respect to the inner frame in opposing horizontal directions.

30 Claims, 11 Drawing Sheets

U.S. PATENT DOCUMENTS 4,682,908 A * 7/1987 Domenighetti ..... 404/84.1
4,688,965 A * 8/1987 Smith et al. ..... 404/75
4,795,332 A * 1/1989 Davis ..... 425/60
4,930,935 A * 6/1990 Quenzi et al. ..... 404/75
5,203,642 A * 4/1993 Heller et al. ..... 404/118
5,222,829 A * 6/1993 Mogler et al. ..... 404/118
5,568,992 A * 10/1996 Grembowicz et al. ..... 404/101
5,752,783 A * 5/1998 Malone ..... 404/84.2
5,863,149 A * 1/1999 Gustin ..... 404/104
5,924,819 A * 7/1999 Breidenbach ..... 404/96
6,019,544 A * 2/2000 Emerson et al. ..... 404/104
6,481,925 B1 * 11/2002 Olson ..... 404/108
6,595,719 B1 * 7/2003 Ohseki et al. ..... 404/118
6,890,125 B1 * 5/2005 Calder et al. ..... 404/104
6,981,820 B2 * 1/2006 Nelson ..... 404/118
7,121,763 B1 * 10/2006 Young et al. ..... 404/118
7,287,931 B2 * 10/2007 Anibaldi et al. ..... 404/104
2002/0106242 A1 * 8/2002 Rahn et al. ..... 404/96
2002/0106243 A1 * 8/2002 Rahn et al. ..... 404/96

FOREIGN PATENT DOCUMENTS

EP 493889 A1 * 7/1992
EP 1239082 A2 * 9/2002

* cited by examiner

EXTENSION SCREED FOR A PAVING VEHICLE

RELATED APPLICATIONS

This application is a 371 of PCT/US2004/007196, filed on Mar. 5, 2004, which claims the benefit of U.S. Provisional Patent Application 60/452,883, filed on Mar. 7, 2003.

BACKGROUND OF THE INVENTION

The present invention relates to paving vehicles, and more particularly to extension screed assemblies for paving vehicles.

Screed assemblies for paving vehicles are known and generally include a main screed having a frame connectable with a paver tractor and one or more screed plates mounted to the bottom of the frame. Often, screed assemblies often include extension screeds mounted to the front or rear of the main screed so as to be laterally movable with respect to the main screed. Such extension screeds provide the capability of forming a wider mat of paving material when the extensions are displaced laterally outwardly and to produce narrower mats when the extensions have been displaced inwardly toward the center of the main screed.

SUMMARY OF THE INVENTION

In one aspect, the present invention is an extension screed for a screed assembly of a paving vehicle, the screed assembly including a main screed. The extension screed comprises a base movably connectable with the main screed and a vertical actuator connectable with the main screed. The vertical actuator is configured to linearly displace the base with respect to the main screed in opposing, generally vertical directions. A carriage is movably connected with the base and is configured to support a screed plate. Further, a horizontal actuator is connected with the base and is configured to linearly displace the carriage with respect to the base in opposing, generally horizontal directions.

In another aspect, the present invention is an extension screed for a main screed of a paving vehicle. The extension screed comprises a first frame movably connectable with the main screed and a vertical actuator connectable with the main screed. The vertical actuator is configured to displace the first frame in generally vertical directions with respect to the main screed. A first horizontal actuator is configured to displace the first frame in generally horizontal directions with respect to the main screed. Further, a second frame is movably connected with the first frame and is configured to support a screed plate. In addition, a second horizontal actuator is configured to displace the second frame with respect to the first frame in generally horizontal directions.

In a further aspect, the present invention is again an extension screed for a main screed of a paving vehicle. The extension screed comprises two base members, each base member being movably connectable with the main screed. Two vertical actuators are each connectable with the main screed and are connected with a separate one of the two base members. Each vertical actuator is configured to linearly displace the connected base member with respect to the main screed in opposing, generally vertical directions. Further, a carriage configured to support a screed plate is connected with each one of the two base members such that the two actuators are configured to displace the carriage with respect to the main screed in opposing, generally vertical directions and to alternatively pivot the carriage with respect to the main screed within a generally vertical plane.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
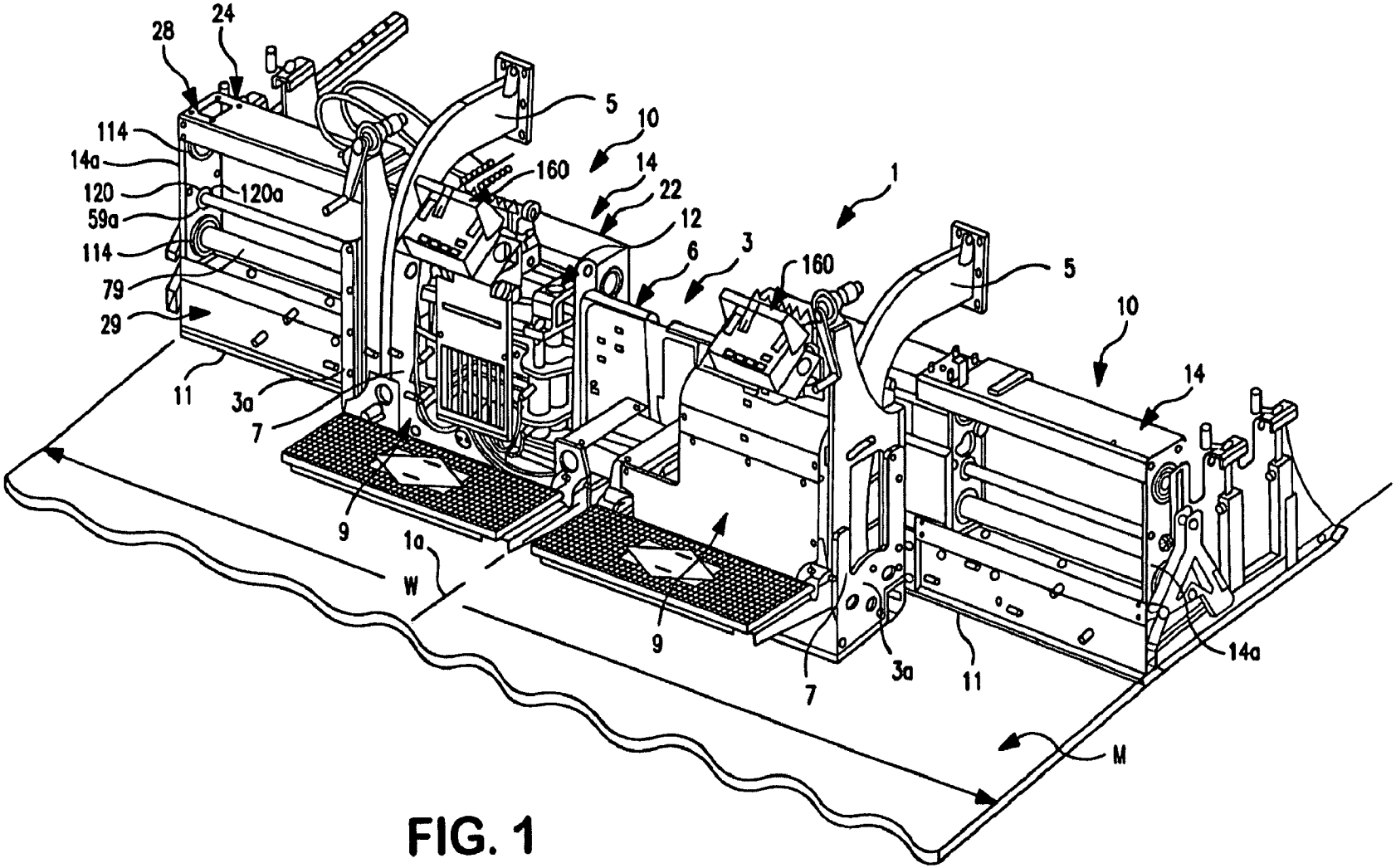
FIG. 1 is a rear perspective view of a screed assembly having two of the extension screed in accordance with the present invention.
Figure 2:
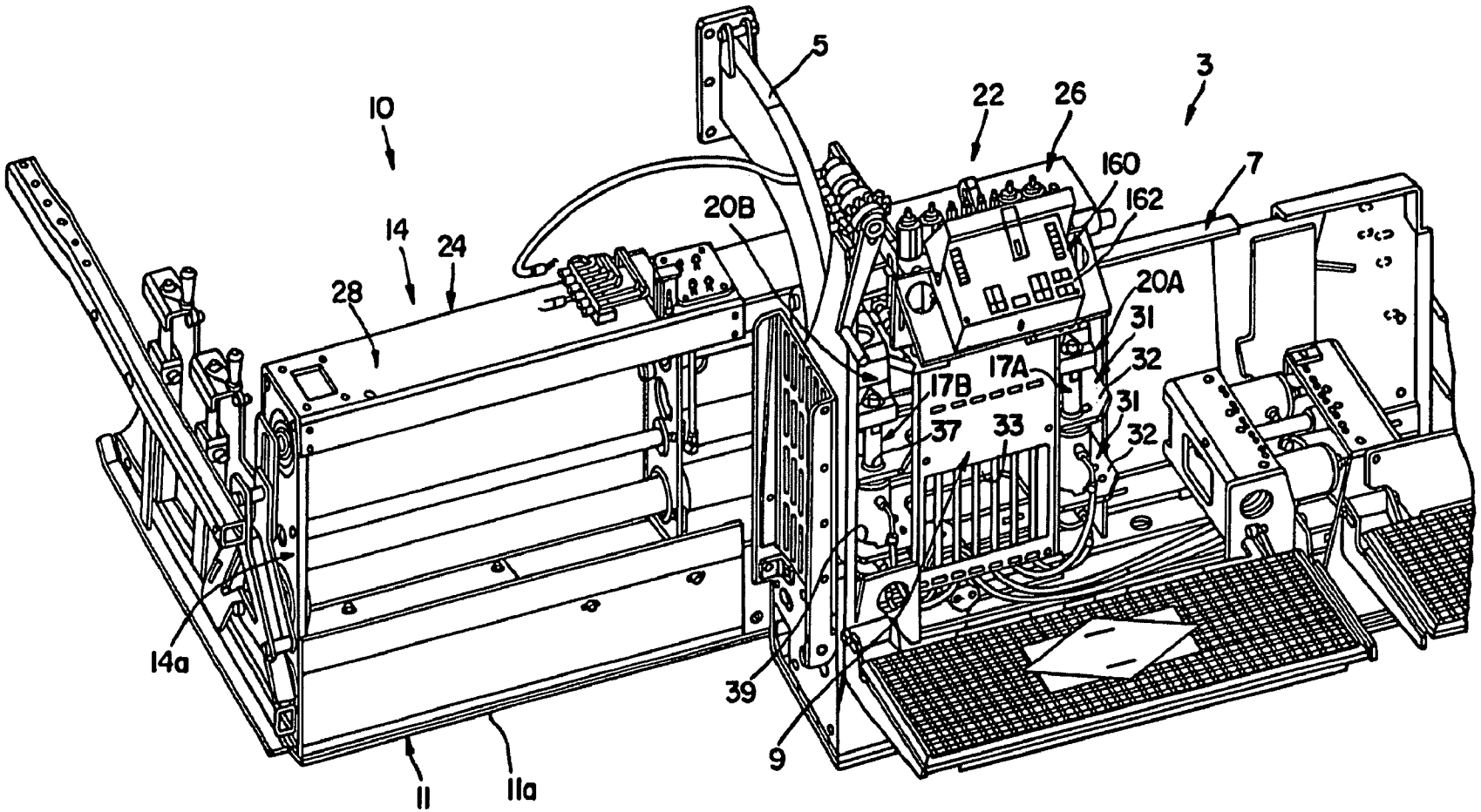
FIG. 2 is a rear perspective view of one half of the screed assembly with one extension screed.
Figure 3:
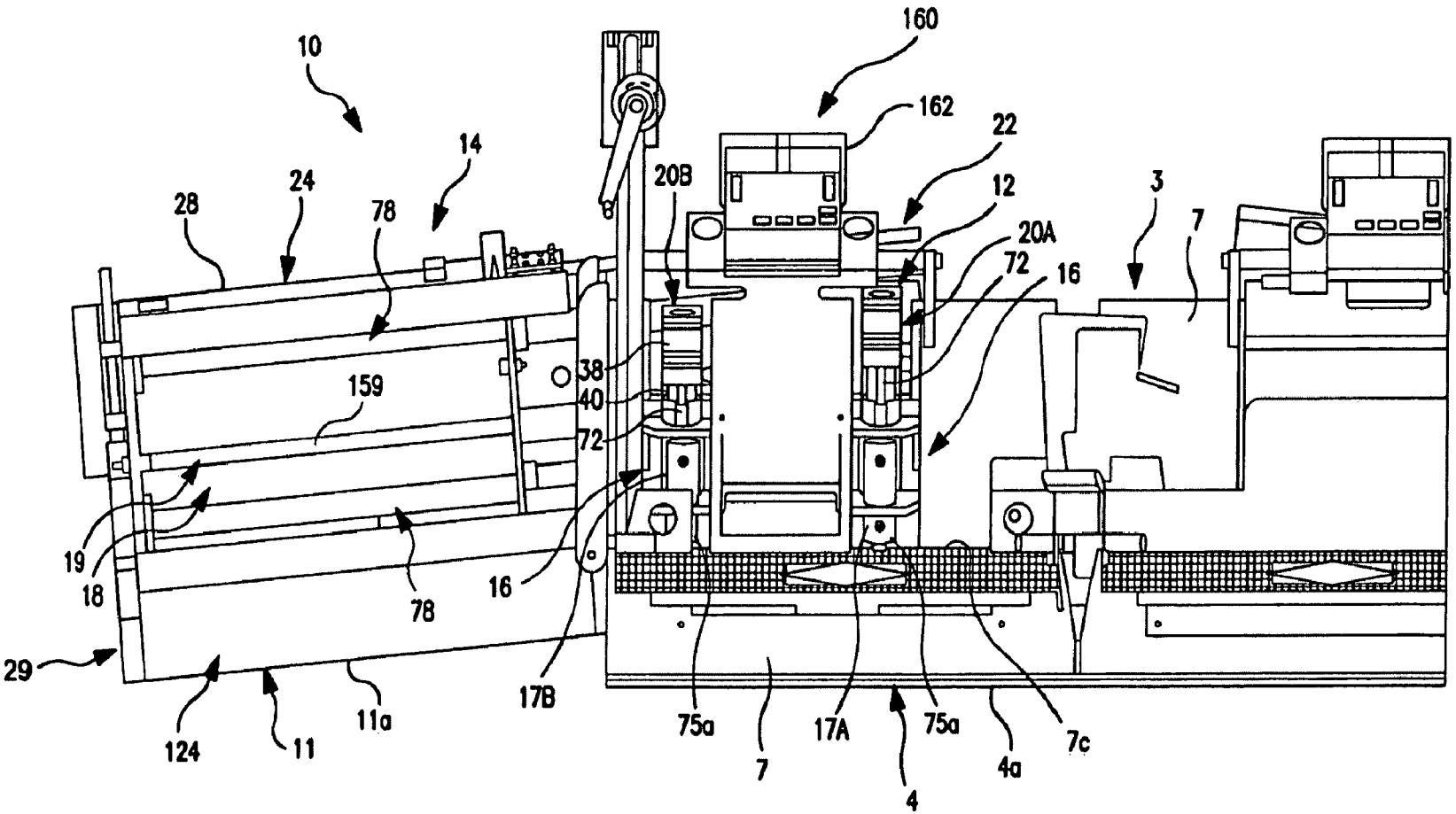
FIG. 3 is a side elevational view of a screed assembly half, shown with the extension screed in a fully extended and pivoted position.
Figure 4:
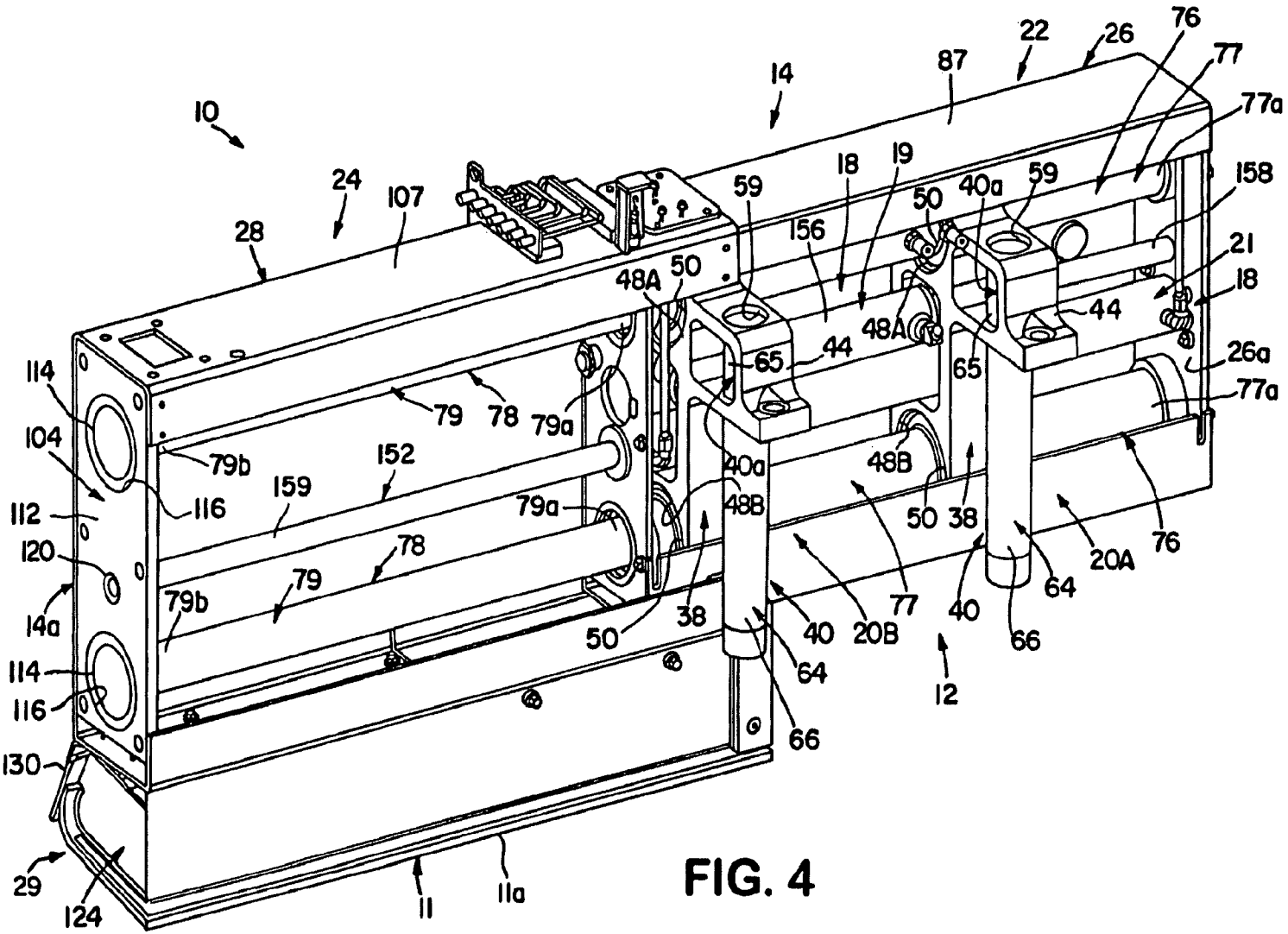
FIG. 4 is an enlarged rear perspective side of the extension screed shown separate from the screed assembly and an in an intermediate extended position.
Figure 5:
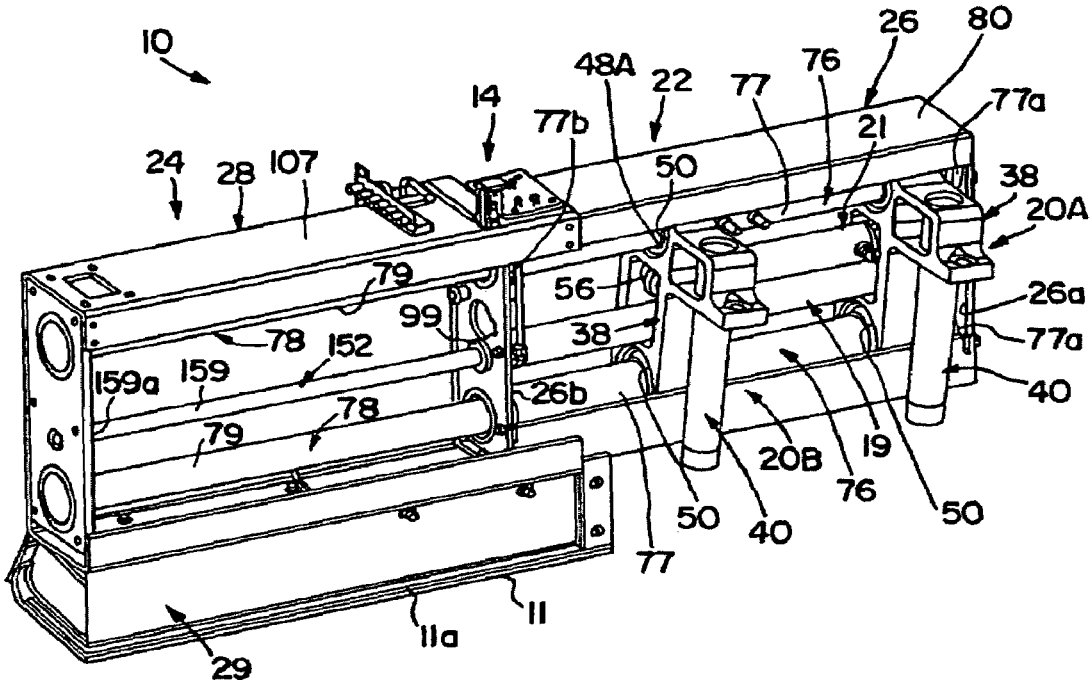
FIG. 5 is a rear perspective view of the extension screed shown in a fully extended position.
Figure 6:
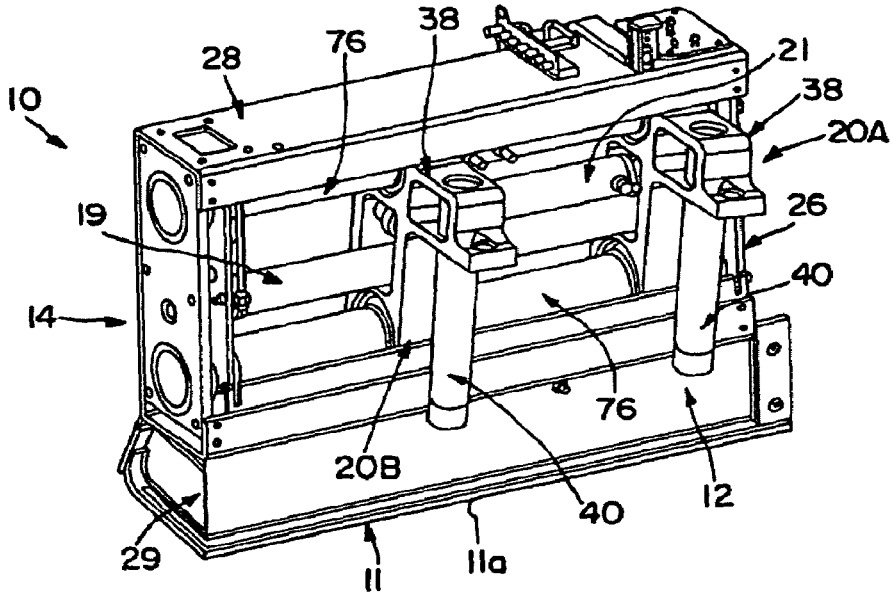
FIG. 6 is a rear perspective view of the extension screed in an alternative intermediate extended position.
Figure 7:
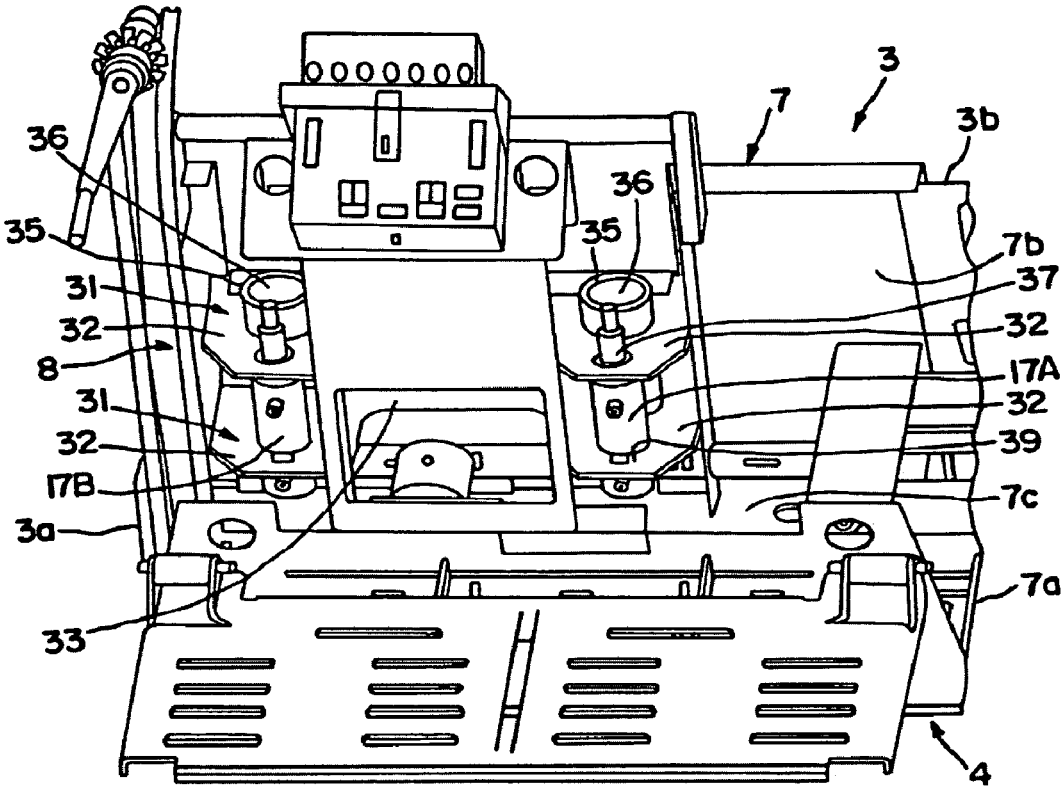
FIG. 7 is a rear perspective view of a main screed half with two preferred vertical actuators of the extension screed.
Figure 8:
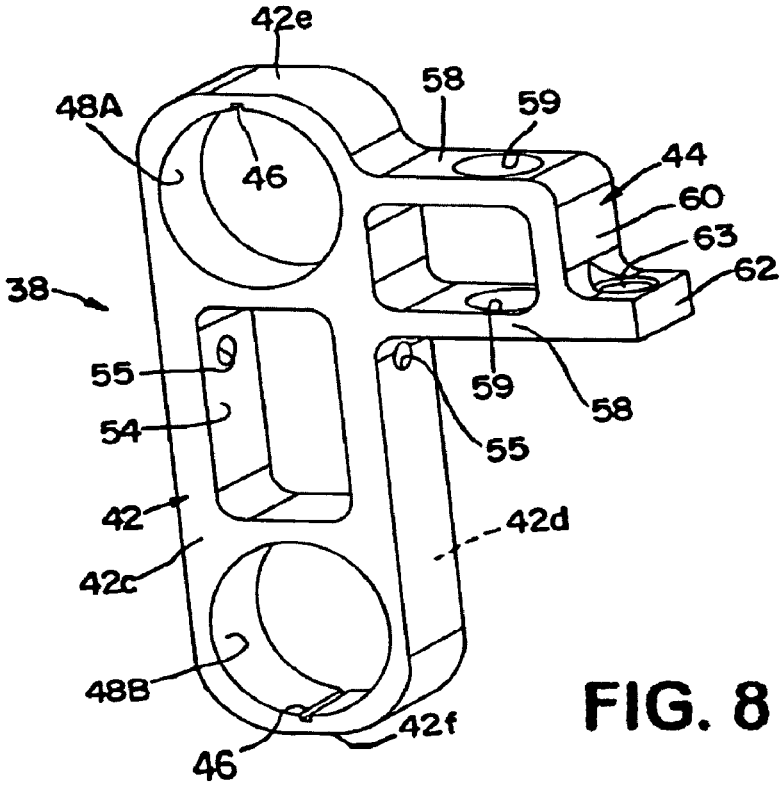
FIG. 8 is a side perspective view of a main body of a preferred base portion of the extension screed.
Figure 9:
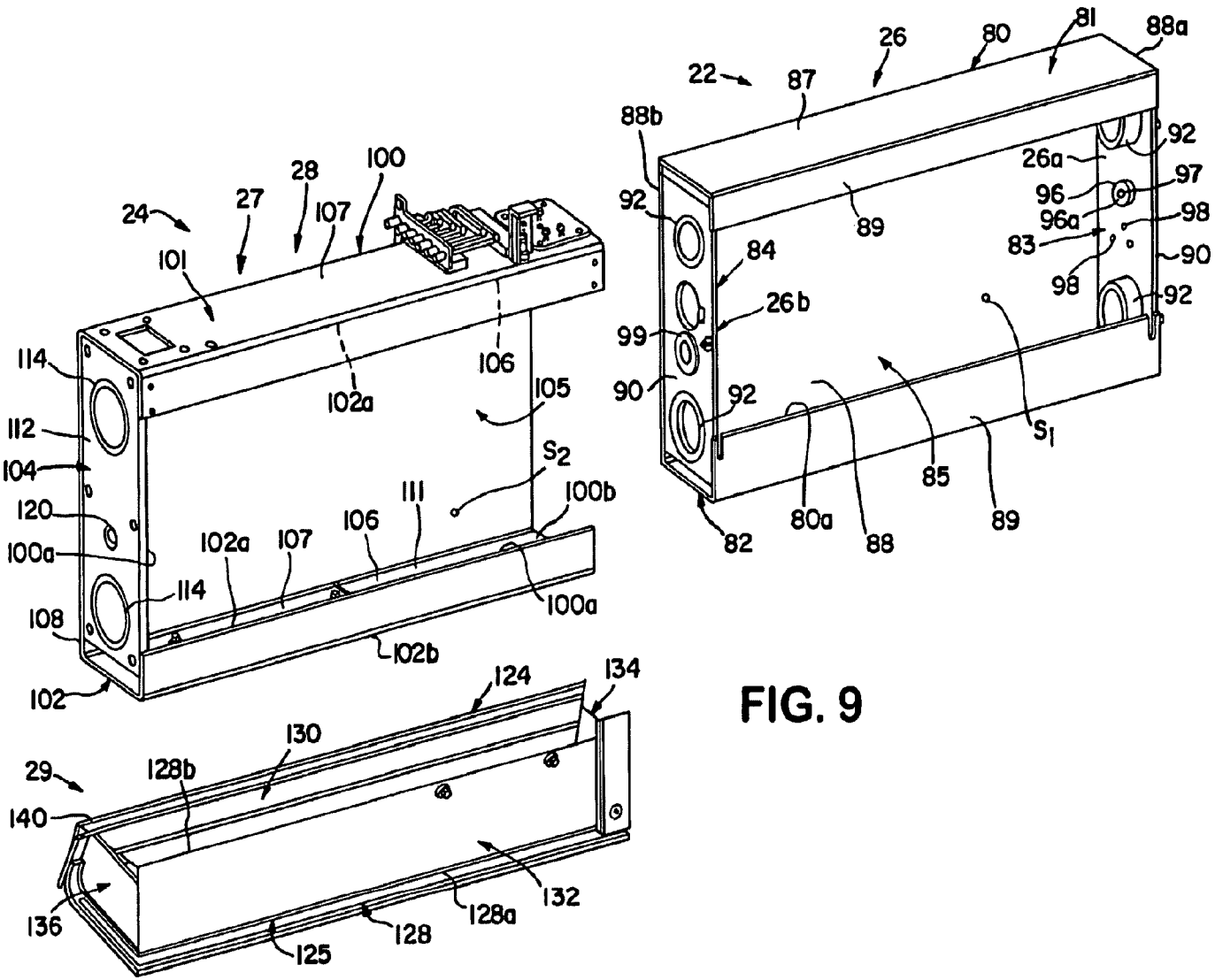
FIG. 9 is an exploded perspective view of three frames of a preferred carriage of the extension screed.

Certain terminology is used in the following description for convenience only and is not limiting. The words "right", "left", "lower", "upper", "upward", "down" and "downward" designate directions in the drawings to which reference is made. The words "inner", "inwardly" and "outer", "outwardly" refer to directions toward and away from, respectively, a designated centerline 1*a* of a screed assembly 1 or a geometric center of an element of an extension screed 10 being described, the particular meaning being readily apparent from the context of the description. Further, the word "lateral" and "laterally" refer to elements of the extension screed 10 or screed assembly 1 that are oriented so as to extend at least partially in a direction generally perpendicular to the screed centerline 1*a*. Furthermore, as used herein, the word "connected" is intended to include both direct connections between two members without any other members interposed therebetween and indirect connections between members in which one or more other members are interposed therebetween. The terminology includes the words specifically mentioned above, derivatives thereof, and words or similar import.

Referring now to the drawings in detail, wherein like numbers are used to indicate like elements throughout, there is shown in FIGS. 1-16 a presently preferred embodiment of an extension screed 10 for a screed assembly 1 of a paving vehicle 2. Such a screed assembly 1 has a longitudinal centerline 1*a* extending generally in a direction of vehicle travel (and thus paving operations) and includes a main screed 3 having at least one screed plate 4. The extension screed 10 basically comprises a base 12 movably connectable with the main screed 3 and a carriage 14 movably connected with the base 10 and configured to support a screed plate 11. At least one vertical actuator 16 is connectable with the main screed 3 and is configured to linearly displace the base 12 with respect to the main screed 3 in opposing, generally vertical, upward and downward directions $V_U$, $V_D$, respectively. Preferably, the vertical actuator 16 is also configured to alternatively pivot the base 12 with respect to the main screed 3 within a generally vertical plane $P_V$ extending vertically through the base 12 (see FIG. 15). Further, a horizontal actuator 18 is connected with the base 12 and is configured to linearly displace the carriage 14 with respect to the base 12 in opposing, outer and inner, generally horizontal directions $H_O$ and $H_I$, respectively, and thus laterally toward and away from, respectively, the screed assembly centerline 1*a*.

As the main screed 3 includes a screed plate 2 and the extension screed 10 further comprises a screed plate 11 mounted to the carriage 14, the extension screed 10 enables the relative positions of the two screed plates 3 and 11 to be adjustable generally in the following manner. When the base 12 and vertical actuator 16 are each connected with the main screed 3 as discussed below, the vertical actuator 16 is configured to displace the base 12 so as to adjust an elevational position of the extension screed plate 11 with respect to the main screed plate 12. In addition, the horizontal actuator 18 is configured to displace the carriage 14 so as to adjust a horizontal position of the extension screed plate 11 with respect to the main screed plate 4. Further, as the main and extension screed plates 4, 11, respectively, each have a lower horizontal working surface 4*a*, 11*a*, respectively, the vertical actuator 16 is configured to also pivot the base 12 with respect to main screed 3 so as to adjust a slope angle $A_S$ between the extension screed plate surface 11*a* and the main screed plate surface 4*a*, as described in greater detail below.

Preferably, the base 12 includes two horizontally spaced-apart base members or portions 20A, 20B, each base portion 20A, 20B being movably connectable with the main screed 3. With such a base structure, the extension screed 10 preferably includes two vertical actuators 16, a first vertical actuator 17A and a second vertical actuator 17B, each being connected with a separate one of the two base portions 20A, 20B, respectively, and preferably removably mounted to the main screed 3. The two vertical actuators 17A, 17B are configured to linearly displace the connected base portion 20A, 20B, respectively, with respect to the main screed 3 in the opposing vertical directions $V_U$ and $V_D$. More specifically, when the two vertical actuators 17A, 17B displace the base portions 20A, 20B by substantially the same distance $d_v$, (e.g., $d_0$ in FIG. 14) with respect to the main screed 3, the carriage 14 and thus the extension screed plate 11 are each substantially vertically displaced with respect to the main screed 3. Further, when the two actuators 17A, 17B displace two base portions 20A, 20B by different vertical distances $d_v$, (e.g., $d_1$, $d_2$ in FIG. 15) with respect to the main screed 3 or displace one base portion 20A or 20B while the other base portion 20B, 20A remains generally stationary, the carriage 14 and screed plate 11 are alternatively pivoted within the vertical plane $P_V$, as discussed in further detail below.

Further, the carriage 14 preferably includes a first, inner section 22 movably connected with the base 12, and thereby connected with the main screed 3 through the vertical actuator(s) 16, and a second, outer section 24. The second carriage section 24 is movably connected with at least the first carriage section 22, and preferably also with the base 12 as discussed below, and is configured to directly support the screed plate 11. Further, the two preferred sections 22, 24 of the carriage 14 are each preferably displaceable along a common axis 25 extending through the entire carriage 14, as discussed in further detail below.

Preferably, the first, inner carriage section 22 includes a first generally rectangular frame 26 that at least partially bounds an interior space $S_1$ and the. base 12 is preferably disposed with the first frame interior space $S_1$. The second, outer carriage section 24 preferably includes a second generally rectangular frame 28 that at least partially bounds an interior space $S_2$, the first frame 26 being disposable at least partially within the second frame interior space $S_2$ such that the second carriage section 24 is displaceable about the first carriage section 26. In other words, the second, outer frame 28 is slidably disposed at least partially about the first frame 26 such that the second frame 28 "telescoping" displaces with respect to the first frame 26 along the axis 25, as discussed in further detail below. Further, when the extension screed 10 is mounted to the main screed 3, the second, outer carriage section 24 provides a carriage outer end 14*a* spaced laterally from the centerline 1, the outer end 14*a* defining a variable, laterally-outermost position of the screed assembly 1, as discussed below.

With a carriage 14 constructed as described above, the extension screed 10 preferably includes two horizontal actuators 18, specifically a first actuator 19 and a second actuator 21. The first horizontal actuator 19 is configured to linearly displace the first, inner frame 26 alternatively in the two outer and inner horizontal directions $H_O$, $H_I$ with respect to the main screed 3. The second horizontal actuator 21 is configured to linearly displace the second, outer frame 28 with respect to the first frame 26 (and thus also with respect to the base 12) alternatively in the two horizontal directions $H_O$ and $H_I$. Preferably, the two horizontal actuators 19 and 21 are each mounted to the base 12 such that both actuators 19, 21 are at least partially disposed within the first frame interior space $S_1$, as described in further detail below.

Figure 10:
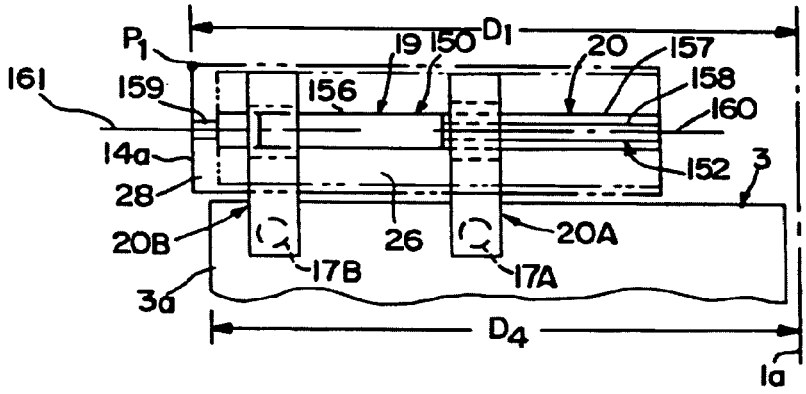
FIG. 10 is a more diagrammatic, top plan view of the extension screed, shown in a retracted position.
Figure 11:
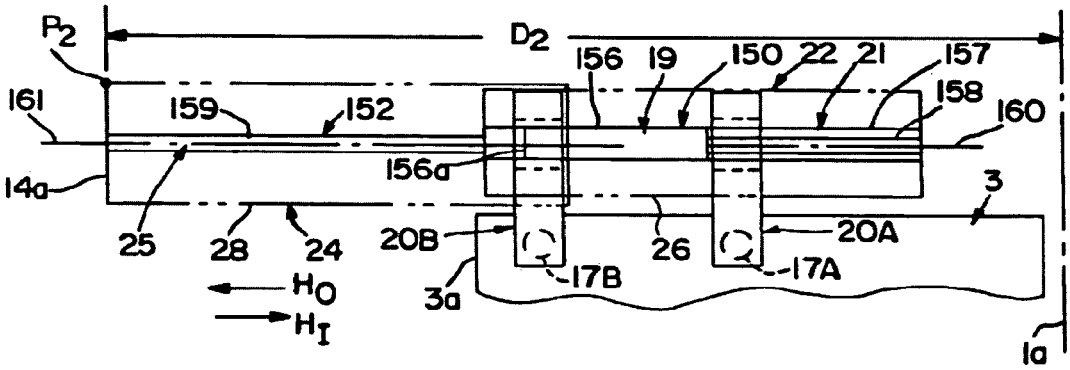
FIG. 11 is another view of the extension screed of FIG. 10, shown in an intermediate extended position.
Figure 12:
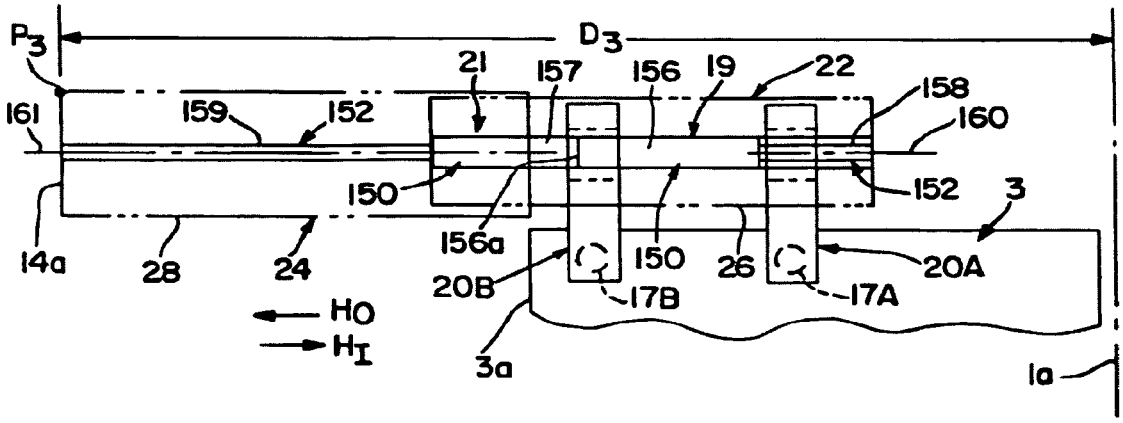
FIG. 12 is another view of the extension screed of FIG. 10, shown in a fully extended position.
Figure 13:
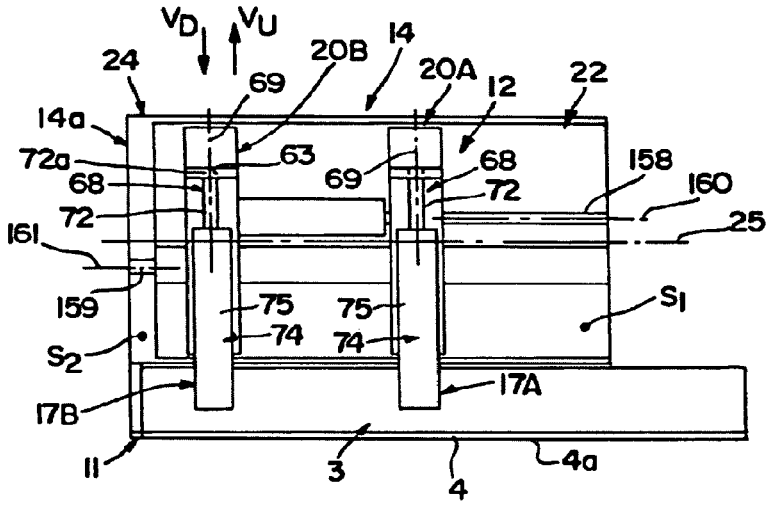
FIG. 13 is a more diagrammatic, side plan view of the extension screed, shown in a retracted position.

As best shown in FIGS. 10-14, the extension screed 10 having the preferred carriage structure is laterally movable, so as to position the extension screed plate 11 to adjust the width W of a paving mat M formable by the screed assembly 1, in generally the following manner. The second horizontal actuator 21 is configured to displace the second carriage section 24 along the axis 25 such that the carriage outer end 14*a* moves between a first horizontal position $P_1$ (FIG. 10), at which the outer end 14*a* is spaced a first perpendicular distance $D_1$ from the centerline 1*a*, and a second horizontal position $P_2$ (FIG. 11). In the second horizontal position $P_2$, the carriage outer end 14*a* is spaced a second perpendicular distance $D_2$ from the centerline 1*a*, the second distance $D_1$ being greater than the first distance $D_1$. Thus, the carriage 14 moves laterally outwardly from the first position $P_1$ to the second position $P_2$, and vice-versa. Further, the first horizontal actuator 19 is configured to displace the first carriage section 22 along the axis 25 such that the carriage outer end 14*a* moves between the second horizontal position $P_2$ and a third horizontal position $P_3$ (FIG. 12). In the third position $P_3$, the carriage outer end 14*a* is spaced a third perpendicular distance $D_3$ from the centerline 1*a*, the third distance $D_3$ being greater than the second distance $D_2$.

Furthermore, the main screed 3 has a lateral outer end spaced 3*a* spaced (i.e., fixedly located) a fourth perpendicular distance $D_4$ (FIG. 10) from the centerline 1*a* and at least the second and third distances $D_2$, $D_3$ are each greater than the fourth distance $D_4$. Thus, the carriage 14 of the extension screed assembly 10 extends laterally outwardly from the main screed 3 when the carriage outer end 14*a* is disposed in at least one the second and third horizontal positions $P_2$, $P_3$, respectively, and preferably also when the carriage end 14*a* is located at the first position $P_1$, as depicted in FIG. 10. However, the extension screed 10 may be configured such that the outer lateral end 14*a* is spaced inwardly from the main screed outer end 3*a*, if desired. Further, the carriage 14 may be may be constructed with only a single section or frame (not shown), such that the carriage 14 only moves between first and second positions $P_1$, $P_2$ (and positionable or locatable at all positions therebetween), as discussed in further detail below. Having described the basic elements of the present invention above, the extension screed assembly 10 and the components thereof are now discussed in greater detail below.

Referring to FIGS. 1-3 and 16, the extension screed 10 of the present invention is preferably used with a screed assembly 1 that is connected to the paving vehicle 2 by a pair of tow arms 5, such that the screed assembly 1 is towed from the rear 2*a* of the vehicle 2. In operation, the vehicle 2 and screed assembly 1 both travel generally along the screed centerline 1*a*, or more accurately stated, the arrangement of the screed 1 with respect to the vehicle 2 causes the screed assembly 1 to be centered about the line 1*a* extending longitudinally through the vehicle 2. Preferably, the extension screed 10 is used as a pair of extension screeds 10 spaced apart laterally so as to be disposed on opposing sides of the assembly centerline 1*a*, although a single extension 10 may be used if so desired. Further, the extension screeds 10 are each preferably mounted to the front end 3*b* of the main screed 3 and generally proximal to a separate main screed lateral end 3*a*, but may alternatively be mounted to the main screed rear end 3*b* or directly to the main screed lateral walls (not indicated) at each lateral end 3*a*. Preferably, the main screed 3 includes a main frame 6 formed of two laterally spaced frame halves 7 pivotally connected at the inner ends 7*a* of the frame halve 7. As such, the main screed 3 is or "crownable" or pivotable about the centerline 1*a*, but may alternatively be formed of a single, fixedly connected frame or of three or more frame sections (no alternatives shown). In addition, each of the preferred frame halves 7 includes a separate screed plate 4 mounted to a lower end of the frame half 7, each main screed plate 4 having a lower working surface 4*a*.

Referring to FIGS. 1-3 and 7, each main screed frame half 7 preferably includes a mounting portion or mount 8 configured to mount the vertical actuator(s) 16, and preferably also the base 12, of one extension screed 10 to the screed 3. Each mount 8 includes a generally vertical base wall 30 providing a section of the screed frame half front wall 7*b* and two vertically spaced apart mounting plates 31 each extending rearwardly from the base wall 30. Each mounting plate 31 includes two outer bracket sections 32 connected by a central rib section 33, such that the plates 31 provide two pairs of upper and lower aligned bracket sections 32. Two tubular mounting bearings 35 each extend generally vertically between and through a separate one of the two pairs of aligned bracket sections 32 and each has a central bore 36 sized to slidably receive a slide post 40 of each of the preferred base portions 20A, 20B, as discussed in further detail below. Further, each pair of aligned bracket sections 32 includes a pair of upper and lower aligned openings 37, 39 sized to receive a separate one of the two preferred vertical actuators 16, as described below.

Although the above screed mounting portions/mounts 8 are preferred, the extension screed 10 of the present invention may be movably connected to the main screed 3 by any appropriate means. For example, the main screed 3 may only have a single mount 8 (i.e., for mounting either a single or both extension screeds 10) or three or more mounts 8. Further for example, each extension screed 10 may be connected to the main screed 3 by a separate device, such as a bracket(s), attached to the screed front end 3*a*, the rear end 3*b*, or to either side 3*c* or 3*d* and configured to connect the base 12 to the main screed 3. As yet another example, the base 12 (and thus the extension screed 10) may be connected with the main screed solely through the one or more vertical actuators 16.

Figure 15:
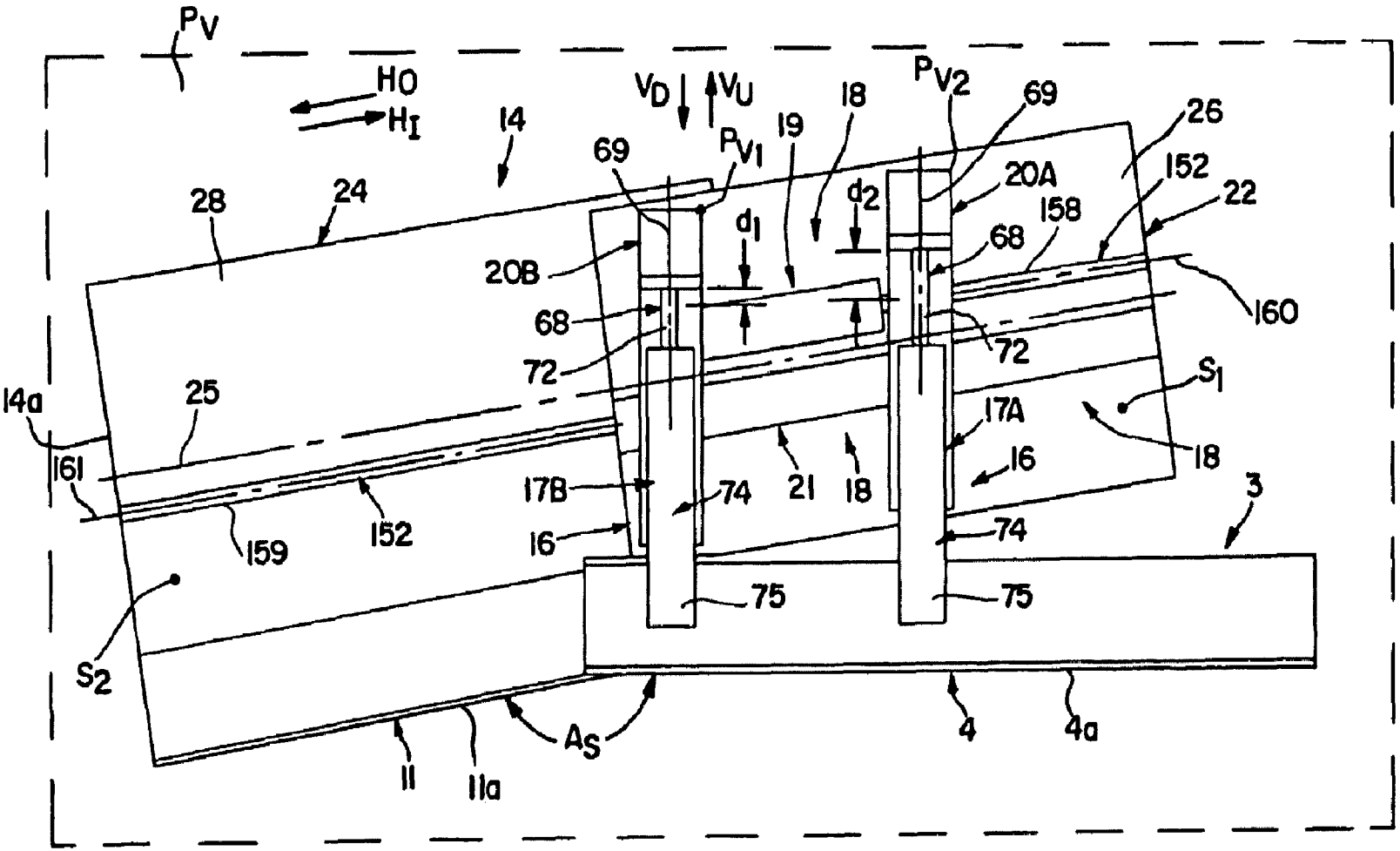
FIG. 15 is another view of the extension screed of FIG. 13, shown in a fully extended and pivoted position.
Figure 16:
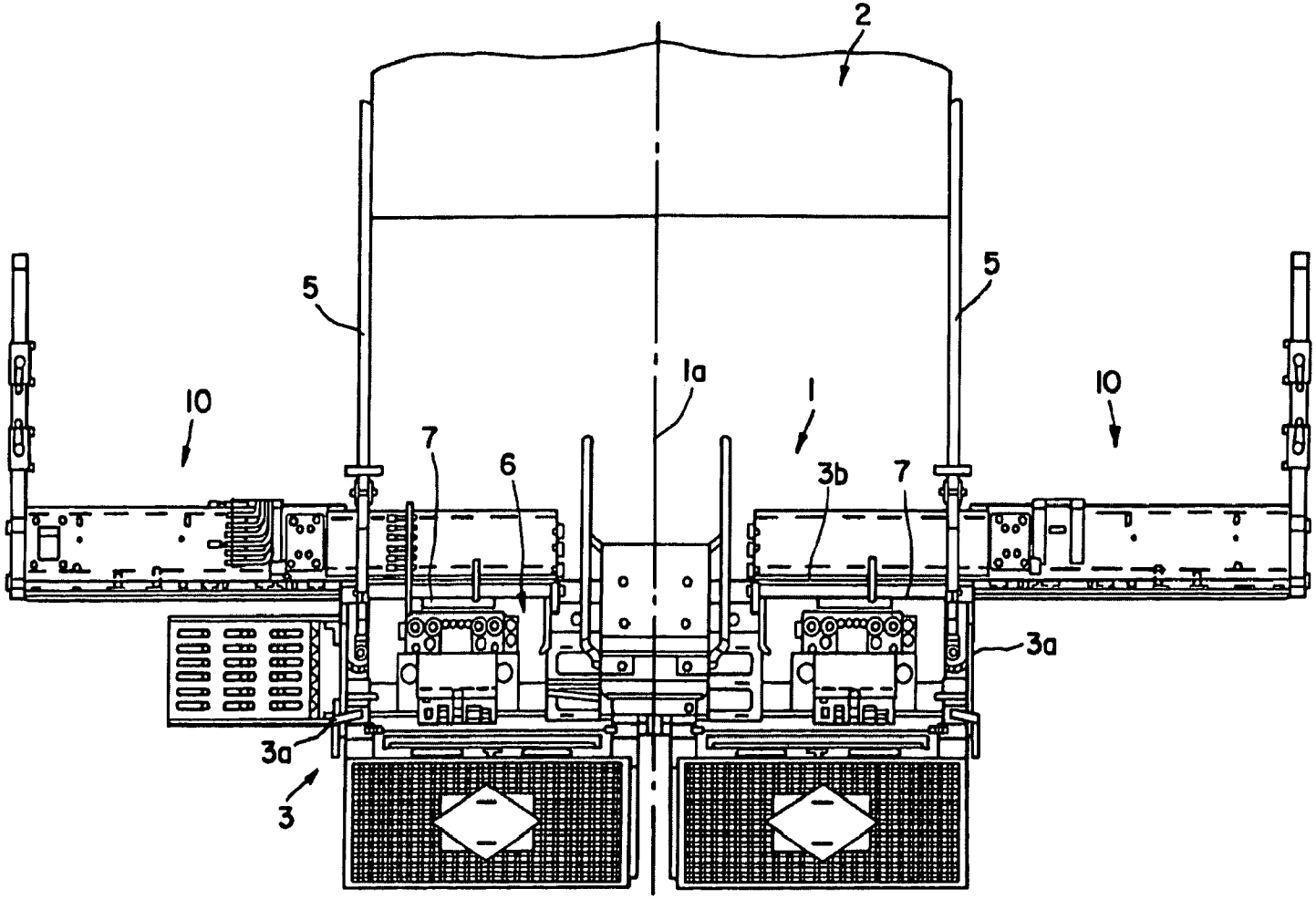
FIG. 16 is a top plan view of the screed assembly of FIG. 1, shown connected with a paving vehicle.

Referring now to FIGS. 4-6 and 8, as discussed above, the base 12 preferably includes a first, inner base member or portion 20A and a second, outer base member or portion 20B, the two base portions 20A, 20B being spaced apart horizontally with respect to the main screed 1. Each base portion 20A, 20B is preferably removably connectable with the main screed 3, specifically by means of the mounting portions 7, as discussed above, but may alternatively be permanently or non-removably connected with the main screed 3 by any appropriate means. As shown in FIG. 15, with a base 12 having two separate portions 20A, 20B, when one of the two base portions 20A, 20B is displaced to a first vertical position $P_{V1}$ spaced a first vertical distance $d_1$ from the main screed surface 4*a* (e.g., base portion 20A) while the other one of the two base portions 20A, 20B is located at a second vertical position $P_{V2}$ spaced a second vertical distance $d_2$ from the main screed surface 4*a*, the first distance d1, being greater than the second distance $d_2$, the carriage 14 is pivotally displaced with respect to the main screed 3 within a generally vertical plane $P_V$, as discussed in further detail below. However, if the base 12 were alternatively constructed of a single frame or body (not shown) as opposed to separate portions, the preferred two vertical actuators 17A, 17B may be connected with such a base 12 so as to still be capable of vertically displacing and/or pivoting the extension screed 10, as discussed below. It must be noted that the positions of the base portions 20A, 20B are indicated by reference to a point "p" on each base portion 20A or 20B, the particular points selected having no particular relevance other than as a convenient point of reference for purposes of discussion of the present invention.

Preferably, the base portions 20A, 20B each include a body 38 and a slide post 40 attached to and extending vertically downwardly from the body 38. The base bodies 38 each preferably include a generally rectangular main section 42 and a connective section 44 extending generally horizontally and rearwardly from a rear vertical surface 42*a* of the body main section 42. The body main section 42 has upper and lower generally circular bearing openings 48A, 48B extending generally horizontally through the body section 42 between opposing left and right vertical surfaces 42*c*, 42*d* of the body section 42, each opening 48A or 48B being configured to receive and slidably support a portion of a first guide member 76, as described below. Preferably, each base body 30 has two circular through-holes 49 and a separate spherical bearing 50 disposed within each through hole 49, such that the bearing openings 48A, 48B are provided by the spherical bearings 50. Alternatively, the body through-holes 49 may each be sized may each be sized to directly support each guide member 76, thus providing one bearing opening 48A or 48B, or the base portions 20A, 20B may each include one or two separate bearings (none shown) mounted at another appropriate location on the associated body 38, such as being attached to the front or rear vertical surfaces 42*b*, 42*a*, respectively, or upper or lower horizontal surfaces 42*e*, 42*f*, respectively. Further, a slotted relief opening 46 extends between the upper surface 42*e* of each body section 42 and the upper bearing opening 48A thereof. Each relief opening 46 provides space for a limited vertical displacement, relative to the base body 38, of the spherical bearing 50 disposed within the upper opening 48A, which is necessary when the two base portions 20A, 20B are displaced vertically relative to each other, as discussed in further detail below.

Further, each base body 38 also includes a generally rectangular, central through-hole 54 extending horizontally through the body main section 42 between the left and right vertical side surfaces 42*c*, 42*d* and is located vertically between the bearing openings 48. The central hole 54 provides clearance space to enable the first and second horizontal actuators 19, 21, respectively, to extend through both base portions 20A, 20B, as discussed below. The outer end 19*a* of the first horizontal actuator 19 is preferably pivotally mounted to the outer base portion 20B by means of a pivot pin 56 disposed within the body central hole 54, also as discussed further below. Preferably, the body main section 42 of the outer base portion 20B has a pair of aligned openings 55 extending into the central hole 54, one extending from the front surface 42*a* and the other extending from the rear vertical surface 42*b*. The pin 56 is installed through the two openings 55 and extends through the actuator inner end 19*a* to rotatably connect the first horizontal actuator 19 to the outer base portion 20B.

Still referring to FIGS. 4-6 and 8, the connective arm section 44 of each base body 38 has a pair of upper and lower horizontal wall sections 58 extending outwardly from the main section rear vertical surface 42*b* and connected together by a vertical wall section 60 spaced horizontally from the main section 42. Each horizontal wall section 58 has a through-hole 59 each vertically aligned with the other hole 59 and configured to receive a portion of the slide post 40. More specifically, each slide post 40 is preferably connected with the associated base body 38 by inserting the upper end 40*a* of the post 40 through both of the openings 59, the post 40 being retained therein either by friction fit with the openings 59, by weldment material or by any other appropriate means. Further, the connective section 44 also includes a mounting tab 62 extending outwardly from the vertical wall section 60 and having a through-hole 63. The mounting tab through-hole 63 is configured to receive a portion of a vertical actuator 16 to connect the actuator 18 with the base 12, as discussed in further detail below.

Preferably, the base main section 42 and connective arm section 44 are integrally formed or connected, such that the base body 38 is generally of one-piece construction. Most preferably, each base body 38 is formed as a single cast block, but may alternatively be formed of two or more separately connected pieces, such as a plurality of attached plates or bars. Further, the base body 38 may be formed in any other appropriate manner, such as a solid block or a frame providing the main section 38, with separate bearings or brackets configured to mount the horizontal actuator(s) 18 and another bracket configured to connect with at least a vertical actuator 16 and preferably also with the main screed 3.

Referring again to FIGS. 4-6 and 8, the slide post 40 of each base portion 20A, 20B is preferably formed as an elongated circular cylindrical bar 64 having an upper end 65 fixedly attached to the base body and a lower end 66 movably attached to the main screed 3. Specifically, the bar upper end 65 extends through the two holes 59 in the connective section 42 of the associated base body 38 and the bar lower end 66 is sidably disposed within a tubular bearing 35 of the main screed mounting portion 8. However, the slide posts 40 may each be alternatively fixedly or immovably attached to the main screed 3 and. slidably disposed in a bearing opening(s) in the base body 38 (structure not shown). Further, the cylindrical bar 64 may have any other appropriate cross-sectional shape, such as for example ovular or rectangular, or the slide post 40 may be a multi-piece fixed or telescoping member (none shown). Further for example, the base portions 20A, 20B may each be constructed without a slide post 40 or any other member for directly connecting the base 12 with the main frame 3, such that the extension screed 10 is then connected to the main screed 3 merely by the one or more vertical actuators 16.

Furthermore, although the base 12 is preferably formed of two horizontally spaced-apart base portions 20A, 20B, the base 12 may be formed in any other appropriate manner. For example, the base 12 may be formed of two separate portions pivotally connected by a joint, linkage or other appropriate means to enable relative vertical displacement of the two base portions, such that the base 12 is "articulating" (structure not shown). Further for example, the base 12 may be formed of a single member, a truss, a box frame or another appropriate frame or assembly of members that is generally rigid and pivotally and/or displaceably connectable with the main screed 3 (none shown). Such a single piece base 12 may either be pivotally connected with the main screed 3 by appropriate means and having a single vertical actuator 16, such that the base 12 merely pivots relative to the main screed 3 but does not vertically displace (i.e., linearly) with respect thereto, may be slidably connected so as to vertically displace but unable to pivot, or may have a slidable pivot connection such that the base 12 is capable of vertically and pivotally displacing. The scope of the present invention includes these and all other appropriate structures of the base 12 that enable the extension screeds 10 to function generally as described herein.

Referring to FIGS. 3-6 and 13-15, as discussed above, the extension screed assembly 10 preferably includes two vertical actuators 16, specifically a first, inner actuator 17A connected with the inner base portion 20A and a second, outer actuator 17B connected with the outer base portion 20A. Preferably each vertical actuator 17A, 17B has a "movable" portion 68 attached to the associated portions 20A, 20B of the base 12 and a "fixed" portion 70 mounted to the main screed 3, i.e., so as to be immovable with respect to the main screed 3. The movable portions 68 are each vertically displaceable with respect to the fixed portion 70, and thus with respect to the main screed 3, along a vertical axis 69 so as to displace the extension screed 10 as described in detail below. Each movable portion 68 is preferably the rod 72 of a hydraulic cylinder 74, as discussed in further detail below, but may alternatively be the movable or "output" component of any other appropriate linear or rotary actuator, as discussed below. As a further alternative, the movable portions 68 (e.g., rods 72) may attached to the main screed 3 and the fixed portions 70 (e.g., cylinders 74) may be mounted on the base 12, such that relative displacement of the movable portions 68 displaces the "fixed" portions 70 and thereby also displaces the base 12.

Figure 14:
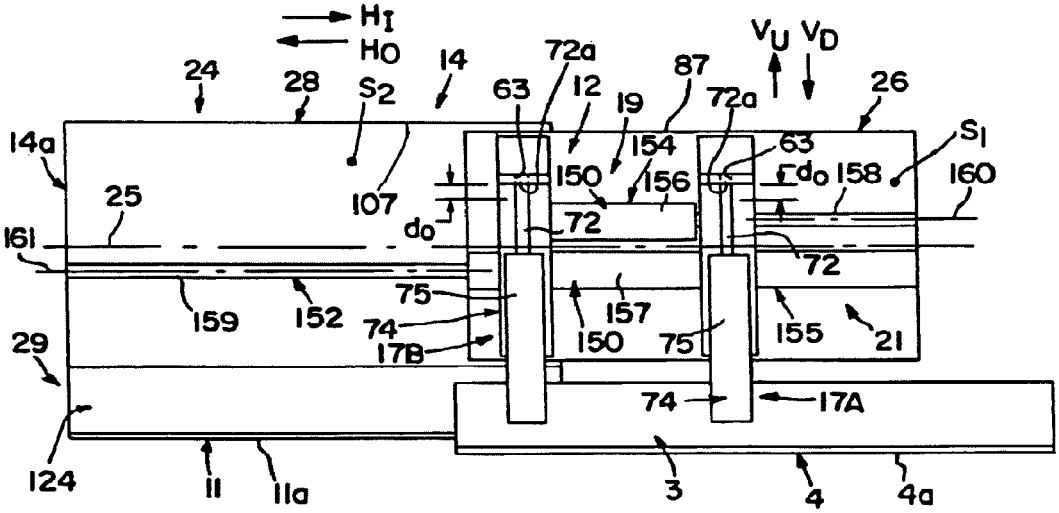
FIG. 14 is another view of the extension screed of FIG. 13, shown in an intermediate extended and elevated position.

In any case, the two preferred vertical actuators 17A, 17B preferably function to vertically displace and/or pivot the extension screed 10 relative to the main screed 3 in the following manner. When the two actuator movable portions 68 are each displaced a substantially equal vertical distance do with respect to the main screed 3, the base 12, and thus the carriage 14, is substantially linearly displaced vertically (i.e., without rotation) with respect to the main screed 3, as shown in FIG. 14. However, when the movable portion 68 of one of the two vertical actuators 16 is displaced a first vertical distance $d_1$ with respect to the main screed 3 (e.g., second actuator 17B) and the movable portion 68 of the other one of the two vertical actuators 16 is displaced a second, greater vertical distance $d_2$ with respect to the main screed 3 (e.g. first actuator 17A), the base 12 and carriage 14 are pivotally displaced with respect to the main screed 3 within a generally vertical plane $P_V$ extending through the extension screed 10, as shown in FIG. 15. Alternatively, the base 12 also pivots within the plane $P_V$ when one actuator movable portion 68 is held stationary while the other actuator movable portion 68 is displaced either upwardly or downwardly. In either case, pivotal displacement of the base 12 with respect to the main screed 3 adjusts a slope angle $A_S$ between the associated extension screed plate working surface 11*a* and the proximal main screed plate working surface 4*a*.

As mentioned above, the two preferred vertical actuators 16 are each preferably a linear actuator and most preferably a hydraulic cylinder 74 having a cylinder body 75 mounted to the main screed 3 and a displaceable (i.e., extendable and retractable) rod 72 attached to the base 12. More specifically, the cylinder body 75 is inserted through the upper and lower openings 37, 39, respectively, in one pair of bracket sections 32 of the mount 8 of one screed frame half 7, such that the lower end 75*a* of the body 75 rests against a horizontal wall 7*c* of the particular main screed frame half 7. Further, the free end 72*a* of the rod 72 is inserted through the opening 63 of the mounting tab 62 of one of the base portions 20A or 20B and retained therein by appropriate means, such as by a pin, so as to thereby connect the actuator 16 to the base 12. Further, the vertical actuators 16 are each fluidly connected with a source of hydraulic fluid, a pump and at least one control valve by means of a hydraulic circuit (none shown), each hydraulic component being mounted at an appropriate location on the extension screed 10 and/or the main screed 3.

However, as discussed above, it is within the scope of the present invention for the vertical actuators 16 to be provided by any other type of actuator capable of vertically displacing the base 12 with respect to the main screed 3. For example, the vertical actuators 16 may each be provided by a motor driven screw, a solenoid, a slider-crank mechanism, by a rack-and-pinion mechanism, a three-bar or four-bar linkage mechanism, a pneumatic cylinder, a solenoid, etc, such that the actuator movable portion 68 is provided by the "nut" or other threaded hole component of a motor-screw actuator, the rack of a rack-and-pinion mechanism, the slider of a slider crank mechanism, the rod of a solenoid, etc. (none shown). Further for example, the extension screed 10 may include only a single vertical actuator 16 or may include three or more vertical actuators 16 (neither shown). The present invention includes these and all other configurations of the vertical actuators 16 that enable the extension screed 10 to function generally as described herein.

Referring now to FIGS. 3-6 and 9, as discussed above, the carriage 14 preferably includes first and second sections 22 and 24, respectively, specifically the inner rectangular frame 26 disposed about the base 12 and the outer rectangular frame 28 disposed at least partially about the inner frame 26. Preferably, the extension screed 10 further comprises at least one and most preferably two first elongated guide members 76 movably connecting the first carriage section 22 with the base 12 and at least one and most preferably two second guide members 78 movably connecting the second carriage section 24 with the first carriage section 22 (and with the base 12). Each first guide member 76 is attached to the inner frame 26 and is slidably connected with the base 12, such that the guide members 76 linearly displace with respect to the preferred base portions 20A, 20B when the first horizontal actuator 19 moves the first carriage section 22, as discussed in further detail below. Preferably, the first guide members 76 each include an elongated tubular body 77 having opposing ends 77*a*, 77*b* attached to facing inner surfaces 26*a*, 26*b* of the inner frame 26, as discussed below, and extending through one pair of the aligned bearing openings 48A or 48B in the base portions 20A, 20B, preferably provided by the central bore of a separate one of the spherical bearings 50. When the first carriage section 22 is displaced with respect to the base 12, the tubular bodies 77 slidably displace through the two base portions 20A, 20B, thereby guiding the horizontal linear displacement of the entire carriage 14 with respect to the base 12. In addition, by being disposed in the spherical bearings 50, the tubular bodies 77 are pivotable with respect to the base portions 20A, 20B, which are restricted to vertical displacement by the slide posts 40, thereby enabling the first frame 26 (and thus the entire carriage 14), to pivot about the base 12.

Further, each of the second guide members 78 is attached to the outer frame 28 and is movably connected with a separate one of the first guide members 76, such that each guide member 78 linearly displaces with respect to the connected first guide member 76 when the second horizontal actuator 21 moves the second carriage section 24, as described in detail below. Preferably, the second guide members 78 each include an elongated post 79 slidably disposed at least partially within the tubular body 77 of the associated first guide member 78 and having a free end 79*a* attached the outer frame 28. When the outer frame 28 is displaced with respect to the inner frame 26, the two guide posts 79 each telescoping displace with respect to the tubular body 77 of the connected first guide member 76, to thereby guide the horizontal linear displacement of the second carriage section 24 with respect to the base 12.

Although the extension screed 10 of the present invention preferably includes the two guide members 76, 78, and preferably a pair of each of the two types of guide members 76 and 78, the carriage 14 may alternatively include only a single member 78 and a single second guide member 78 connected therewith or three or more pairs of first and second guide members 76 and 78. Further, the carriage 14 may be alternatively constructed without any guide members 76 or 78 and be guided by portions of the inner fame 26 and/or outer frame 28.

Referring to FIGS. 4-6, 9 and 13-15, the first or inner frame 26 is preferably formed as a generally rectangular box 80 having an open rear end 80*a* and defining or bounding the generally hollow interior space $S_1$ of the frame 26 (discussed above). The first frame interior space $S_1$ is sized to contain the preferred two base portions 20A, 20B, the first guide members 78, the first horizontal actuator 19 and a major portion of the second horizontal actuator 21, as discussed above and in further detail below. Preferably, the first frame box 80 includes five wall sections or walls: top and bottom walls 81 and 82, respectively, inner and outer side walls 83 and 84, respectively, and a front wall 85. The top and bottom walls 81 and 82 each extend generally horizontally and generally parallel with the other wall 82 or 81 and each has an outer surface 81*a*, 82*a*, respectively, slidably contactable with portions of the outer frame 28. As such, the two walls 81 and 82 each function as a separate one of a pair of rails 87 for supporting telescoping movement of the outer frame 28 with respect to the inner flame 26, as discussed above and in further detail below.

Further, the front wall 85 extends generally vertically between the front edges (not indicated) of the top and bottom walls 81, 82 and generally horizontally between the front edges (not indicated) of the two side walls 83, 84. The front wall 85 functions to cover or enclose the front end 80*a* of the frame box 80 and to connect the top and bottom walls 81 and 82. Preferably, the top wall 81, the bottom wall 82 and the front wall 85 are all provided by a single, generally C-shaped plate 88 that further includes two vertical lips 89 extending from inwardly from the rear edges of the top and bottom walls 81, 82, respectively. However, the preferred inner frame box 80 may alternatively be constructed of three separate plates each providing one of the walls 81, 82, and 83 or the box 80 may be formed without a front wall 85 and having two separate plates, bars, etc., providing the top and bottom walls 81 and 82 (neither alternative shown).

Further, the inner and outer side walls 83 and 84, respectively, each extend generally vertically and generally parallel with the other side wall 85, 84, respectively, and also generally perpendicular with respect to the top and bottom walls 81 and 82 and with respect to the front wall 85. Each side wall 83 and 84 is preferably formed as a generally flat, generally rectangular plate 90 and are each attached to the C-shaped plate 88 proximal to a separate side edge 88*a*, 88*b* thereof. The two side walls 84, 85 are configured to support portions of the two preferred horizontal actuators 19 and 21 and the two preferred first guide members 76, as described below.

Preferably, each side wall plate 90 includes two generally tubular support collars 92 each disposed in a separate one of two vertically-spaced circular openings 94 and sized to receive a tubular end 77*a* of one of the first guide members 76. The support collars 92 in each side wall 83, 84 are each generally aligned with one collar 92 in the other side wall 84, 83, respectively, such that each horizontally-spaced pair of aligned collars 92 support one of the two first guide members 76, and thereby connects the member 76 with the first frame 26. Further, the inner side wall 83 includes a circular mounting plate 96 disposed generally between the two collars 92 configured to attach a rod end 158*a* of the preferred first horizontal actuator 19 (as discussed below) to the inner frame 26. More specifically, the plate 96 has an inner surface 96*a* against which the first actuator rod end 158*a* is abutted and a through-hole 97 sized to permit insertion of threaded fastener (not indicated) through the plate 96 so as to engage with a threaded hole (not indicated) in the rod 158, and thereby removably connect the first actuator 19 to the first flame 26 of the carriage 14. Additionally, the inner side wall plate 90 also has a plurality of mounting holes 98 located proximal to the attachment plate 96 sized and arranged to enable a base end 157*a* of the preferred second actuator 21 (described below) to be attached to the first frame 26 by means of threaded fasteners (not indicated) inserted through the holes 98. Furthermore, the outer side wall 84 includes an annular bearing plate 99 disposed generally between the two collars 92 of the side wall 84 and having a bearing opening 99*a* sized to receive and slidably support a rod 159 of the preferred second horizontal actuator 21, as discussed below. Thus, the second horizontal actuator 21 extends generally between the two side walls 83, 84 of the inner frame 26 and into the outer frame 28.

Still referring now to FIGS. 3-6, 9 and 13-15, the second or outer frame 28 of the second carriage section 24 preferably includes an upper, carrier subframe 27 slidably connected with the first, inner frame 26 and a lower, screed support subframe 29 attached to the carrier subframe 29. The carrier subframe 27 is preferably formed as a generally rectangular box 100 having an open rear end 100*a* and an open inner side end 100*b*, the box 100 bounding the second frame interior space $S_2$, as mentioned above. The second frame box 100 is sized larger than the first frame box 80 such that the first, inner frame 26 is receivable within the second frame interior space $S_2$. With this structure, the outer frame 28 linearly displaces with respect to the inner fame 26 by slidably displacing about the inner frame box 80 along the axis 25 such that greater or lesser portions, depending on the direction of the displacement, of the inner frame 26 are disposed within the second frame interior space $S_2$, as described in further detail below. Preferably, the outer frame box 100 includes four wall sections or walls: top and bottom walls 101, 102, respectively, an outer side wall 104 and a front wall 105.

Preferably, the top and bottom walls 101 and 102 each extend generally horizontally and generally parallel with the other wall 102, 101 and are spaced apart by a greater vertical distance (not indicated) than the vertical spacing distance (not indicated) between the top and bottom walls 81, 82 of the inner frame box 80. The top and bottom walls 101, 102 each have an inner contact surface 106 slidably contactable with the outer surfaces 81*a*, 82*a* of the top and bottom walls 81, 82, respectively, of the inner frame 26. As such, the two walls 101, 102 function as slide members 107 that slidably displace against the rail members 87 of the inner frame 26 when the second carriage section outer frame 28 displaces with respect to the first carriage section inner frame 26 (and with respect to the base 12). By having the outer frame upper wall 102 disposed generally upon the inner frame upper wall 82, the inner frame 26 preferably at least partially supports the weight of the second carriage section 26. Preferably, the contact surfaces 106 of the outer frame top and bottom walls 101 and 102 are provided by a separate bearing pad 111 attached to the wall inner surfaces 101*a*, 102*a*, but may alternatively by provided directly by the wall inner surfaces 101*a*, 102*a*. Further, the bottom wall outer of lower surface 102*b* is configured to attach the screed plate subframe 29 to the carrier subframe 27, preferably through various components (hydraulic cylinders, adjusting screws, etc.—none shown) for pivoting the screed plate subframe 29 with respect to the carrier subframe 27, and thereby to the carriage 14, as described in further detail below.

Furthermore, the front wall 105 extends generally vertically between the front edges (not indicated) of the top and bottom walls 101, 102 and generally horizontally between the box open side end 100*b* and the front edge 104*a* of the outer side wall 104. The front wall 105 functions to cover or enclose the front end of the frame box 100 and to connect the top and bottom walls 101 and 102. Preferably, the top wall 101, the bottom wall 102 and the front wall 105 are all provided by a single, generally C-shaped plate 108 that further includes two vertical lips 109 extending from inwardly from the rear edges of the top and bottom walls 101, 102, respectively. However, the preferred outer frame box 100 may alternatively be constructed of three separate plates each providing one of the walls 101, 102, and 105 or the box 100 may be formed without a front wall 105 and having two separate plates, bars, etc., providing the top and bottom walls 101, 102 (neither alternative shown).

Further, the outer side wall 104 extends generally vertically and generally parallel with the outer side or end wall 85 of the inner frame 26 (i.e., when the frames 26 and 28 are assembled together) and also extends generally perpendicularly with respect to the top and bottom walls 101 and 102 and with respect to the front wall 105. The side wall 104 is preferably formed as a generally flat, generally rectangular plate 112 attached to the C-shaped plate 108 proximal to the plate outer side edge 108*a*. The side wall 104 is configured to support a portion of the preferred second horizontal actuator 21 and the two preferred second guide members 78. Preferably, the side wall 104 includes two generally circular mounting flanges 114 each disposed in a separate one of two vertically-spaced circular openings 116 in the plate 112 and configured to attach a separate one of the two second guide members 78 to the outer frame 28. More specifically, each mounting flange 114 has a plurality of spaced apart holes (not indicated) through each which is inserted a threaded fastener (not indicated) engageable with the free end of the guide posts 79 to attach the two guide posts 79 to the outer frame 28. Further, the outer side wall 104 includes a circular mounting plate 120 disposed generally between the two mounting flanges 114 and configured to attach a rod end 159*a* of the preferred second horizontal actuator 21 (as discussed below) to the inner outer frame 26. More specifically, the mounting plate 120 has an inner surface 120*a* against which the second actuator rod end 159*a* is abutted and a through-hole 121 sized to permit insertion of threaded fastener (not indicated) through the plate 120 so as to engage with a threaded hole (not indicated) in the rod 159, and thereby removably connect the second actuator 21 to the outer frame 28 of the carriage 14.

Furthermore, the screed support subframe 29 is preferably formed as an elongated, generally rectangular box 124 having a lower mounting surface 125 configured to support a screed plate 11. Preferably, the subframe box 124 includes a generally horizontal bottom wall 126, generally vertical and parallel front and rear walls 130, 132, respectively, and generally vertical and parallel inner and outer side walls 134, 136, respectively. The screed support subframe 29 is preferably attached to the carrier subframe 27, specifically to the bottom wall 102, by at least at least one hinge and at least one actuator (neither shown) for pivoting the subframe 29 and screed plate 11 relative to the remainder of the carriage 14, but may alternatively be fixedly connected to the carrier subframe by any appropriate means. The bottom wall 128 has a lower surface 128*a* against which the upper surface of the screed plate 11 is disposable, such that the screed plate 11 is mountable to the carriage 14 by a plurality of threaded posts (not shown) of the screed plate 11 being inserted through a plurality of corresponding openings (not shown) in the bottom wall 128. The subframe front wall 126 is configured to attach a strike-off plate 140 to the carriage 14 and functions to prevent paving material from depositing on the upper surface 128*b* of the bottom wall 128. Although the subframe 29 is preferably formed as described above, the subframe may be formed in any other appropriate manner, such as a rectangular box having open front and rear ends, or the carriage 14 may be constructed without a support subframe and with the screed plate 11 being directly mounted to the outer frame 28 or connected to the outer frame 28 by appropriate means, such as one or more mounting brackets or mounting spacer plates (no alternatives shown).

Further, although the carriage 14 is preferably formed of two sections 22, 24 that include inner and outer frames 26, 28, respectively, it is within the scope of the present invention to construct the carriage 14 in any other appropriate manner. For example, the inner and outer carriage sections 22, 24 may each be formed with an appropriate structure other than as a rectangular box frame as described above, such as a skeletal truss, a single "backboard" member or plate, a solid bar or beam, etc., of any appropriate shape (no alternatives shown). Further for example, the carriage 14 may include only a single section (i.e., as opposed to inner and outer sections) of any appropriate construction, connectable with the base 12 and configured to support the screed plate 11. The scope of the present invention encompasses these and all other appropriate structures of the carriage 14 capable of supporting the screed plate 11 and enabling the extension screed 10 to function generally as described herein.

Referring now to FIGS. 3-6 and 10-15, the two horizontal actuators 18 each preferably include a first, fixed portion 150, preferably connected with the base 12 and a second, movable portion 152 connected with either the first carriage section 22 or the second carriage section 24 and displaceably connected with the fixed portion 150. As such, displacement of each actuator movable portion 152 with respect to the corresponding actuator fixed portion 150 displaces the carriage section 22 or 24 with respect to the base portion 12. Preferably, each one of the first and second actuators 19 and 21, respectively, is a hydraulic cylinder 154, 155, respectively, that includes a cylinder body 156, 157 and a piston rod 158, 159, respectively, disposed at least partially within the respective cylinder body 156 and 157. The piston rods 158 and 159 are displaceable, i.e., extendable or retractable, with respect to the connected body 156, 157 along a separate cylinder axis 160, 161, respectively, so as to displace the connected frame 26, 28, respectively, as discussed above and in further detail below. Further, the horizontal actuators 18 are each fluidly connected with a source of hydraulic fluid, a pump and at least one control valve by means of a hydraulic circuit (none shown), each hydraulic component being mounted at an appropriate locations on the extension screed 10 or on the main screed 3.

Preferably, the cylinder body 156 of the first horizontal actuator 19 has a base end 156*a* disposed within the central through-hole 54 of the outer base portion 20B and pivotally attached therewithin by the pin 56 as described above. The actuator body 156 extends from the outer base portion 20B and into the central through-hole 54 of the inner base portion 20A and the actuator rod 158 extends to the inner side wall 83 of the inner frame 26 and is attached to the mounting plate 96 described above. Further, the second actuator body 157 has a base end 157*a* attached the inner frame inner side wall 83, preferably by fasteners inserted through the mounting holes 98, and an inner end 157*b* is disposed against the bearing plate 99, the second actuator body 157 being spaced vertically generally below the first actuator body 156. The second actuator rod 159 extends through the bearing plate 99, horizontally across the second frame interior space $S_2$ and has an outer end 159*a* attached to the mounting plate 120 on the outer frame outer side wall 105 as described above. Preferably, the first and second horizontal actuators 19 and 21 are spaced apart vertically such that the two rod axes 160 and 161 are generally disposed in a common vertical plane, preferably plane $P_V$ as discussed above and depicted in FIG. 15

Although the two horizontal actuators 18 are preferably hydraulic cylinders 154, 155, either or both of the first and second actuators 19 and 21 may be provided by any other type of actuator capable of horizontally displacing the carriage 14 with respect to the base 12, and thus the main screed 3. For example, the horizontal actuators 18 may each be provided by a motor driven screw, a solenoid, a slider-crank mechanism, by a rack-and-pinion mechanism, a three-bar or four-bar linkage mechanism, a pneumatic cylinder, a solenoid, etc, such that the actuator movable portion 152 is provided by the "nut" or other threaded hole component of a motor-screw actuator, the rack of a rack-and-pinion mechanism, the slider of a slider crank mechanism, the rod of a solenoid, etc. Further for example, the extension screed 10 may include only a single horizontal actuator 18, such as if the carriage 14 included only a single frame (not shown), or may include three or more horizontal actuators 18. The present invention includes these and all other configurations of the horizontal actuators 18 that enable the extension screed 10 to function generally as described herein.

Referring to FIGS. 10-15, the preferred horizontal actuators 19, 21 function to displace the first and second carriage sections 22, 24, respectively, generally in the following manner. When the first and second frames 26, 28 are each located in inner, "retracted" positions with respect to the main screed 3 (e.g., FIGS. 10 and 13), the rod 159 of the second horizontal actuator 21 is extendable outwardly along the rod axis 161 so as to push the second frame 28, and thus the screed plate 11, to displace with respect to the first frame 26 in the outward horizontal direction $H_O$ and generally away from the screed centerline 1*a*. As discussed above, such movement of the second actuator 21 moves the carriage outer end 14*a* from the first horizontal or lateral position $P_1$ to the second lateral position $P_2$, or to an intermediate position located therebetween (none indicated), so as to thereby increase the overall effective width of the screed assembly, and thus the width of a mat of paving material formed by the screed assembly 1. To further increase the overall effective width W of the screed assembly 1, the rod 158 of the first horizontal actuator 19 is retractable along the rod axis 160 so as to pull the first frame 28, and thus also the second frame 28 and thereby screed plate 11, to displace with respect to the first base 12 in the outward horizontal direction $H_O$ and generally away from the screed centerline 1*a*. As is also described above, such movement of the first actuator 19 moves the carriage outer end 14*a* from the second position $P_2$ to the third lateral position $P_3$, or to an intermediate position located therebetween (none indicated). Alternatively, the extension screed 10 may be extended by first using the first horizontal actuator 19 to displace the entire carriage 14 outwardly and then using the second horizontal actuator 21 to displace the second carriage section 24 outwardly, each separate movement being implemented as described above.

To retract the extension screed 10 from the outermost or extended position, the first horizontal actuator 19 is extendable along the rod axis 160 so as to push the first frame 26 (and thus second frame 28) to displace in the inward horizontal direction $H_I$ and generally toward the screed centerline 1*a* Thereafter, the second horizontal actuator 21 is retractable along the rod axis 161 so as to pull the second frame 28 to displace in the inward horizontal direction $H_I$ and generally toward the screed centerline 1*a*, such that the carriage outer end 14*a* is located proximal to the outer end of the main screed 3. Alternatively, the extension screed 10 may be retracted by first using the second horizontal actuator 21 to displace the second carriage section 24 inwardly and then using the first horizontal actuator 19 to displace the entire carriage 14 inwardly, each separate movement being implemented as described above. Further, when the extension screed 10 is in an extended position, the vertical actuators 16 may be used to pivot or slope the extension screed 10 with respect to the main screed 3, and thereby adjust the angle $A_S$ between the extension screed plate working surface 11*a* with respect to the main screed plate working surface 4*a*, in the manner described above and depicted in FIG. 15. Due to the fact that the two carriage frames 26 and 28 each displace along a common axis 25, the Referring to FIGS. 1-3, the extension screed assembly 10 preferably further includes a control system 160 configured to automatically operate the one or more vertical actuators 16 and the one or more horizontal actuators 18 so as to automatically and remotely position the extension screed 10 relative to the main screed 1. The control system 160 includes a controller 162, preferably located in the operator station 9 on the main screed 3, a plurality of control valves (none shown) each controlling hydraulic flow into a separate one of the preferred hydraulic actuators 17A, 17B, 19 and 21 and one or more position sensors (none shown) configured to determine the actual position of the actuator rods 72, 158 and 159 or the frames 26, 28. The control system 160 enables a screed operator to automatically linearly displace and/or pivotally displace the base 12 and/or the carriage 14, and thereby also displace the extension screed plate 11, to a desired position with respect to the main screed 3.

It will be appreciated by those skilled in the art that changes could be made to the embodiments or constructions described above without departing from the broad inventive concept thereof. It is understood, therefore, that this invention is not limited to the particular embodiments or constructions disclosed, but it is intended to cover modifications within the spirit and scope of the present invention as defined in the appended claims.

We claim:

1. An extension screed for a screed assembly of a paving vehicle, the screed assembly including a main screed, the extension screed comprising:

a base movably connectable with the main screed, the base having opposing lateral ends;

a first vertical actuator connectable with the main screed, the first vertical actuator being connected with the base and configured to linearly displace one lateral end of the base with respect to the main screed in opposing, generally vertical directions along a first vertical actuator axis, the first vertical actuator axis being fixed relative to the main screed;

a second vertical actuator connectable with the main screed so as to be horizontally spaced from the first actuator, the second vertical actuator being connected with the base and configured to displace the other lateral end of the base with respect to the main screed in opposing, generally vertical directions along a second vertical actuator axis, the second vertical actuator axis being fixed relative to the main screed;

a carriage movably connected with the base and configured to support an extension screed plate, the first vertical actuator and the second vertical actuator cooperating through the base to displace the carriage with respect to the main screed in opposing, generally vertical directions and to alternatively pivot the carriage with respect to the main screed within a generally vertical plane; and a horizontal actuator connected with the base and configured to linearly displace the carriage with respect to the base in opposing, generally horizontal directions along a horizontal actuator axis, the horizontal actuator axis being fixed relative to the carriage.

2. The extension screed as recited in claim 1 wherein the main screed includes a screed plate and the extension screed further comprises a screed plate mounted to the carriage such that when the base and the first vertical actuator and the second vertical actuator are connected with the main screed, the first vertical actuator and the second vertical actuator are configured to displace the base so as to adjust an elevational position of the extension screed plate with respect to the main screed plate and the horizontal actuator is configured to displace the carriage so as to adjust a horizontal position of the extension screed plate with respect to the main screed plate.

3. The extension screed as recited in claim 2 wherein each one of the main and extension screed plates has a lower horizontal working surface and the first vertical actuator and the second vertical actuator are configured to pivot the base with respect to main screed so as to adjust a slope angle between the extension screed plate surface and the main screed plate surface.

4. The extension screed as recited in claim 1 wherein:

the carriage includes a first section movably connected with the base and a second section movably connected with the first section, the horizontal actuator being a first horizontal actuator and configured to linearly displace the first carriage section with respect to the base; and the extension screed further comprises a second horizontal actuator configured to displace the second carriage section with respect to the first carriage section in opposing, generally horizontal directions.

5. The extension screed as recited in claim 4 wherein:

the main screed has a longitudinal centerline extending generally in a direction of paving vehicle travel and the second carriage section provides a carriage outer end spaced laterally from the centerline;

the second horizontal actuator is configured to displace the second carriage section such that the carriage outer end moves between a first horizontal position at which the carriage outer end is spaced a first perpendicular distance from the centerline and a second horizontal position at which the carriage lateral end is spaced a second perpendicular distance from the centerline, the second distance being greater than the first distance; and the first horizontal actuator is configured to displace the first carriage section such that the carriage outer end moves between the second horizontal position and a third horizontal position at which the carriage outer end is spaced a third perpendicular distance from the centerline, the third distance being greater than the second distance.

6. The extension screed as recited in claim 5 wherein the main screed has a lateral outer end spaced a fourth perpendicular distance from the centerline and at least the second and third distances are each greater than the fourth distance such that the extension screed extends laterally outwardly from the main screed when the carriage outer end is disposed in one of the second horizontal position and the third horizontal position.

7. The extension screed assembly as recited in claim 4 wherein the second carriage section is disposed at least partially about the first carriage section such that the second horizontal actuator is configured to telescoping displace the second carnage section with respect to the first carriage section.

8. The extension screed assembly as recited in claim 4 wherein the main screed has a longitudinal centerline extending in a direction of paving vehicle travel, the extension screed has a central axis extending through the base and the carriage and generally perpendicularly with respect to the centerline, the first horizontal actuator is configured to displace the carriage generally along the central axis and the second horizontal actuator is configured to displace the second carriage section generally along the central axis.

9. The extension screed as recited in claim 4 further comprising:

a first elongated guide member attached to the first carriage section and slidably connected with the base so as to movably connect the first carriage section with the base, the first guide member linearly displacing with respect to the base when the first horizontal actuator moves the first carriage section; and a second elongated guide member attached to the second carriage section and movably connected with the first guide member so as to movably connect the second carriage section with the first carriage section, the second guide member linearly displacing with respect to the first guide member when the second horizontal actuator moves the second carriage section.

10. The extension screed as recited in claim 9 wherein the base includes a bearing opening and the first guide member is slidably disposed within the base bearing opening.

11. The extension screed as recited in claim 9 wherein one of the first and second guide members includes an elongated tubular body and the other one of the first and second guide members includes an elongated post slidably disposed at least partially within the tubular body such that the post telescoping displaces with respect to the tubular body when the second carriage section displaces with respect to the first carriage section.

12. The extension screed as recited in claim 4 wherein the first carriage section includes a rail member and the second carriage section includes a slide member slidably disposed upon the rail member such that the first carriage section at least partially supports the weight of the second carriage section and the slide member displaces upon the rail when the second carriage section displaces with respect to the base.

13. The extension screed as recited in claim 4 wherein the first and second horizontal actuators each have a central axis, the first carriage section is displaceable along the first actuator axis and the second carriage section is displaceable along the second actuator axis, the two actuators being spaced apart vertically such that the two axes are generally disposed in a common vertical plane.

14. The extension screed as recited in claim 4 wherein the main screed includes a longitudinal centerline extending generally in a direction of paver travel, first carriage section has an inner lateral end and the first horizontal actuator is a hydraulic cylinder having a first displaceable cylinder rod, the first displaceable cylinder rod being attached to the carriage inner lateral end such that retraction of the first displaceable cylinder rod displaces the carriage generally away from the centerline and extension of the first displaceable cylinder rod displaces the carriage generally toward the centerline.

15. The extension screed as recited in claim 4 wherein:

the first carriage section includes a first frame, the first frame at least partially bounding an interior space, the base being disposed within the first frame interior space; and the second carriage section includes a second frame, the second frame at least partially bounding an interior space, the first frame being disposable at least partially within the second frame interior space such that the second carriage section is displaceable about the first carriage section.

16. The extension screed as recited in claim 4 wherein the base includes a first body and a second body spaced horizontally from the first body, the first and second horizontal actuators each extending between and being connected with each one of the two base bodies.

17. The extension screed as recited in claim 1 wherein each one of the first and second vertical actuators has a movable portion attached to the base and vertically displaceable with respect to the main screed such that when the two actuator movable portions are each displaced a substantially equal vertical distance with respect to the main screed, the base is linearly displaced vertically with respect to the main screed.

18. The extension screed as recited in claim 17 wherein when the movable portion of one of the two vertical actuators is displaced a first vertical distance with respect to the main screed and the movable portion of the other one of the two vertical actuators is displaced a second, greater vertical distance with respect to the main screed, the base is pivotally displaced with respect to the main screed within a generally vertical plane.

19. The extension screed as recited in claim 18 wherein the main screed includes a screed plate with a generally horizontal working surface and the extension screed further comprises a screed plate mounted to the carriage and having a generally horizontal working surface, such that pivotal displacement of the base with respect to the main screed adjusts a slope angle between the main screed working surface and the extension screed working surface.

20. The extension screed as recited in claim 1 wherein the base includes a first portion and a second portion, the two base portions being spaced apart horizontally with respect to the main screed, the first vertical actuator being connected with the base first portion and the main screed, and the second vertical actuator being connected with the base second portion and the main screed.

21. The extension screed as recited in claim 20 wherein:

when the two base portions are each displaced a substantially equal distance with respect to the main screed, the carriage is linearly displaced vertically with respect to the main screed; and when one of the two base portions is displaced a first vertical distance with respect to the main screed and the other one of the two base portions is displaced a second, greater vertical distance with respect to the main screed, the carriage is pivotally displaced with respect the main screed within a generally vertically plane.

22. The extension screed as recited in claim 20 wherein the main screed has a generally horizontal surface and when one of the two base portions is displaced to a first vertical position spaced a first vertical distance from the main screed surface while the other one of the two base portions is located at a second vertical position spaced a second vertical distance from the main screed surface, the first distance being greater than the second position, the carriage is pivotally displaced with respect to the main screed within a generally vertical plane.

23. The extension screed as recited in claim 20 wherein the main screed includes two horizontally spaced apart mounting bearings and each one of the first and second base portions includes a post, each one of the two base portion posts being slidably disposed within a separate one of the two mounting bearings to displaceably connect the base with the main screed.

24. The extension screed as recite in claim 20 wherein each one of the first and second base portions has a bearing opening and the extension screed further comprises an elongated guide member extending through each one of the two base bearing openings and having opposing ends attached to the carriage so as to connect the carriage with the base, the guide member being configured to slidably displace through the two base bearing openings when the horizontal actuator displaces the carriage with respect to the base.

25. The extension screed as recited in claim 1 wherein the main screed includes a longitudinal centerline extending generally in a direction of paving vehicle travel and the carriage has an outer lateral end, the horizontal actuator being configured to displace the carriage such that the carriage outer end is movable between a first, most proximal position with respect to the main screed centerline and a second most distal position with respect to the main screed.

26. The extension screed as recited in claim 1 wherein the main screed includes a mounting bearing and the base includes a post slidably disposed within the mounting bearing to displaceably connect the base with the main screed.

27. The extension screed as recited in claim 1 wherein the base includes two base portions spaced apart horizontally, each base portion being independently displaceably connected with the main screed and connected with the carriage.

28. The extension screed as recited in claim 1 wherein the carriage includes a first, inner carriage section disposed about the base and a second, outer carriage section slidably disposed at least partially about the inner carriage section and displaceable with respect to the first carriage section.

29. An extension screed for a main screed of a paving vehicle, the extension screed comprising:

two base members, each base member being independently movably connectable with the main screed;

two vertical actuators each connectable with the main screed and connected with a separate one of the two base members, each vertical actuator being configured to linearly displace the connected base member with respect to the main screed in opposing, generally vertical directions along an associated vertical actuator axis, each vertical actuator axis being fixed relative to the main screed; and a carriage configured to support an extension screed plate and connected with each one of the two base members for vertical movement with each of the two base members and for horizontal movement relative to each of the two base members, the two vertical actuators cooperating to displace the carriage and the extension screed plate with respect to the main screed in opposing, generally vertical directions and to alternatively pivot the carriage and the extension screed plate with respect to the main screed within a generally vertical plane.

30. An extension screed for a main screed of a paving vehicle, the extension screed comprising:

a first base member and a second base member each movably connectable with the main screed;

a first vertical actuator connectable with the main screed, the first vertical actuator being connected with the first base member and configured to linearly displace the first base member with respect to the main screed in opposing, generally vertical directions;

a second vertical actuator connectable with the main screed in a position horizontally spaced from the first actuator, the second actuator being connected with the second base member and configured to displace the second base member with respect to the main screed in opposing, generally vertical directions;

a carriage connected with the first base member and the second base member for vertical movement with the first base member and the second base member and for horizontal movement relative to the first base member and the second base member, the carriage being configured to support an extension screed plate; and a horizontal actuator connected with at least one of the first base member and the second base member and configured to linearly displace the carriage with respect to the first base member and the second base member in opposing, generally horizontal directions;

wherein the first vertical actuator and the second vertical actuator cooperate through the first base member and the second base member to displace the carriage with respect to the main screed in opposing, generally vertical directions and to alternatively pivot the carriage with respect to the main screed within a generally vertical plane; and wherein, with the carriage pivoted relative to the main screed to a carriage pivoted position about a pivot point and with the first base member and the second base member held in position relative to the main screed, the horizontal actuator is operable to linearly displace the carriage with respect to the first base member and the second base member while the pivot point is maintained in a fixed position relative to the main screed.

* * * * *

UNITED STATES PATENT AND TRADEMARK OFFICE

CERTIFICATE OF CORRECTION

PATENT NO. : 7,651,295 B2
APPLICATION NO. : 10/548349
DATED : January 26, 2010
INVENTOR(S) : Eppes et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 372 days.

Signed and Sealed this

Twenty-eighth Day of December, 2010

David J. Kappos

David J. Kappos
*Director of the United States Patent and Trademark Office*